US006656414B2

(12) United States Patent
De Souza et al.

(10) Patent No.: US 6,656,414 B2
(45) Date of Patent: Dec. 2, 2003

(54) DEVICE FOR CONTINUOUSLY MEASURING THE TEMPERATURE IN PELLETIZING FURNACES

(75) Inventors: Claudemir Chateaubriand De Souza, Epirito Santo (BR); Noboru Yamane, Espirito Santo (BR)

(73) Assignee: Companhia Vale Do Rion Doce, Santa Luzia MG (BR)

( * ) Notice: Subject to any disclaimer, the term of this patent is extended or adjusted under 35 U.S.C. 154(b) by 0 days.

(21) Appl. No.: 10/010,733

(22) Filed: Nov. 8, 2001

(65) Prior Publication Data

US 2003/0085496 A1 May 8, 2003

(51) Int. Cl.[7] ..... C21D 11/00

(52) U.S. Cl. ..... 266/80; 266/87; 266/178; 266/279

(58) Field of Search ..... 266/87, 80, 279, 266/178

(56) References Cited

U.S. PATENT DOCUMENTS 3,949,974 A * 4/1976 Shiokawa et al. ..... 266/178
6,197,249 B1 * 3/2001 Vaananen et al. ..... 266/87

* cited by examiner

*Primary Examiner*—Melvyn Andrews
(74) *Attorney, Agent, or Firm*—Katten Muchin Zavis Rosenman

(57) ABSTRACT

A device for continuously measuring the temperature in pelletizing furnaces basically comprised of a plurality of temperature detectors (1, 2) disposed at fixed sites on the grate car (10) that follow the latter along the furnace and inform continuously and instantaneously the actual burning temperature of the product at the detected site through data collectors and measuring units; said data collectors being enclosed in housings (20) which also are attached to the grate car (10) in order to follow the latter while it moves through the interior of the furnace.

7 Claims, 5 Drawing Sheets

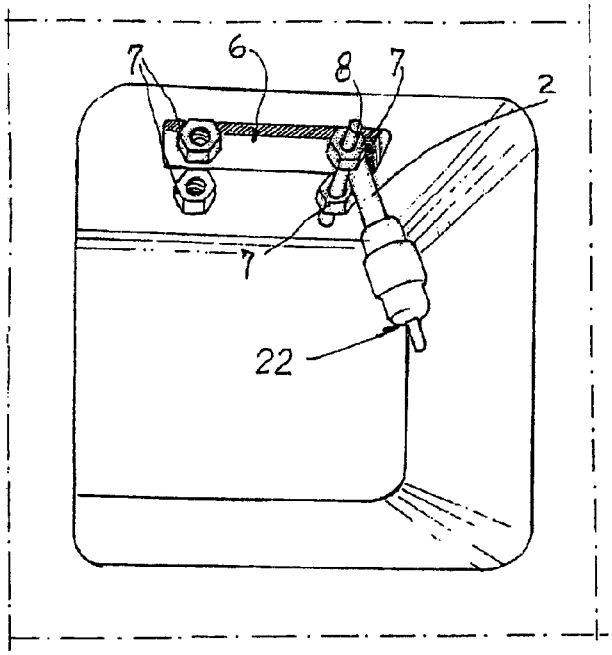
FIG.-5
FIG -6
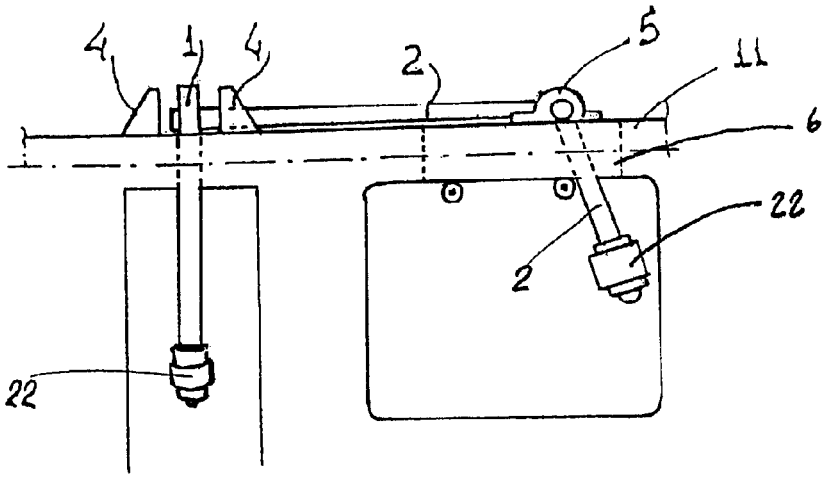

DEVICE FOR CONTINUOUSLY MEASURING THE TEMPERATURE IN PELLETIZING FURNACES

DISCLOSURE OF THE INVENTION

The present invention is related to a device for continuously measuring the temperature in pelletizing furnaces and, more particularly, to a system for continuously measuring the temperature in pelletizing and sintering furnaces, which is resistant to the aggressive environment found in the grate cars used for pelletizing and/or sintering operations.

It is known that in pelletizing and sintering processes it is always important to check the pellet burning range, in order to optimize the consumption of fuel used therein, besides assuring a suitable product quality; furthermore, said verification is required for evaluating the effect of the process temperatures on the thermal treatment of the grate cars.

Conventionally, in order to measure the temperature in the pelletizing grate cars, the operators promote short stops along the course of the grate car in order to insert temperature detectors on the sides thereof, thus detecting timely and promptly the temperature of the pellets, as well as that of the grate car, at that time.

Besides the fact that the grate car stop approach for measuring the temperature has been widely used, it brings about a number of drawbacks, examples of which can be the fact that the grate car stop generates distortions in the thermal balance of the furnace and also causes a random distribution throughout the pellet layer.

When such distortions occur, the actual process burning temperature cannot be attained, what it makes it difficult to get the aimed results and masks the measurement values.

In order to minimize the inconveniences of the grate car stops, the use of meters, called travelers, was then adopted, which meters were launched with the product as the burning process went on. This attempt has not attained compensating results, for the meters were submitted to a risk of irreversible damage, thus requiring the frequent collection thereof for analysis.

Therefore, one of the objects of the present invention is to provide a device for continuously measuring the temperature in pelletizing furnaces that allows for a continuous measurement of the product while the grate car moves along the furnace, without the occurrence of damages to the meters or any interference in the pelletizing or sintering process.

Another object of the present invention is to provide a device for continuously measuring the temperature in pelletizing furnaces that allows for a continuous evaluation of the burning process temperature and its influence on the mechanical structures of the grate car that moves along the furnace, thus making it possible to optimize the fuel consumption and improving the product quality.

Another object of the present invention is to provide a device for continuously measuring the temperature in pelletizing furnaces that may have different temperature measuring sites in a single grate car, thus making it possible to analyze the pelletizing and/or sintering process temperature at different levels and sites of the product present on the grate car.

These and other objects and advantages of the present invention are attained by using a device for continuously measuring the temperature in pelletizing furnaces comprising the provision of a plurality of temperature detectors disposed at fixed sites on the grate cars, which detectors are however selectively and vertically displaceable in relation to the grate car support plan and follow the latter along the furnace in order to continuously and instantaneously inform the actual burning temperature of the product at that site and/or product layer depth being burned and at each stage of said process; wherein all the detectors are connected to a data collector which is encapsulated and also attached to the grate car and follow the latter as it moves through the interior of the furnace, each data collector being interconnected by tightening lines to said detectors and permanently monitored by measuring units that receive and determine through graphs the thermal profile of the process between two measuring sites selected.

The present invention will be described below with reference to the accompanying drawings, wherein.

Figure 7:
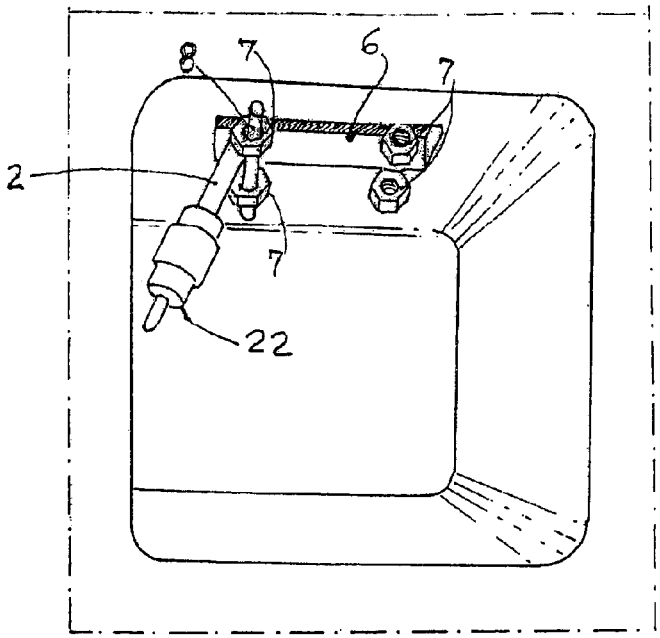
Figure 8:
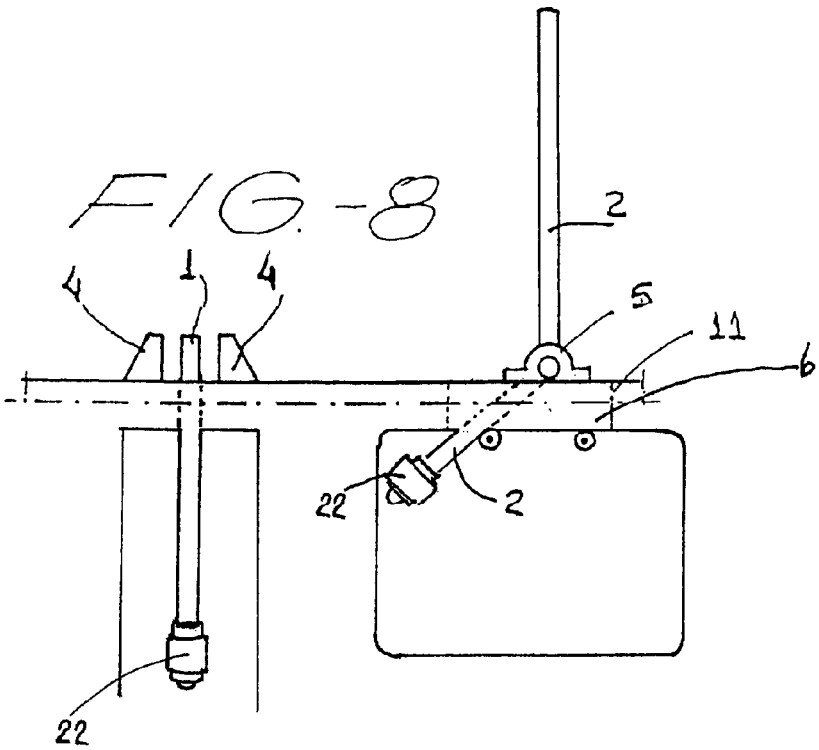
Figure 9:
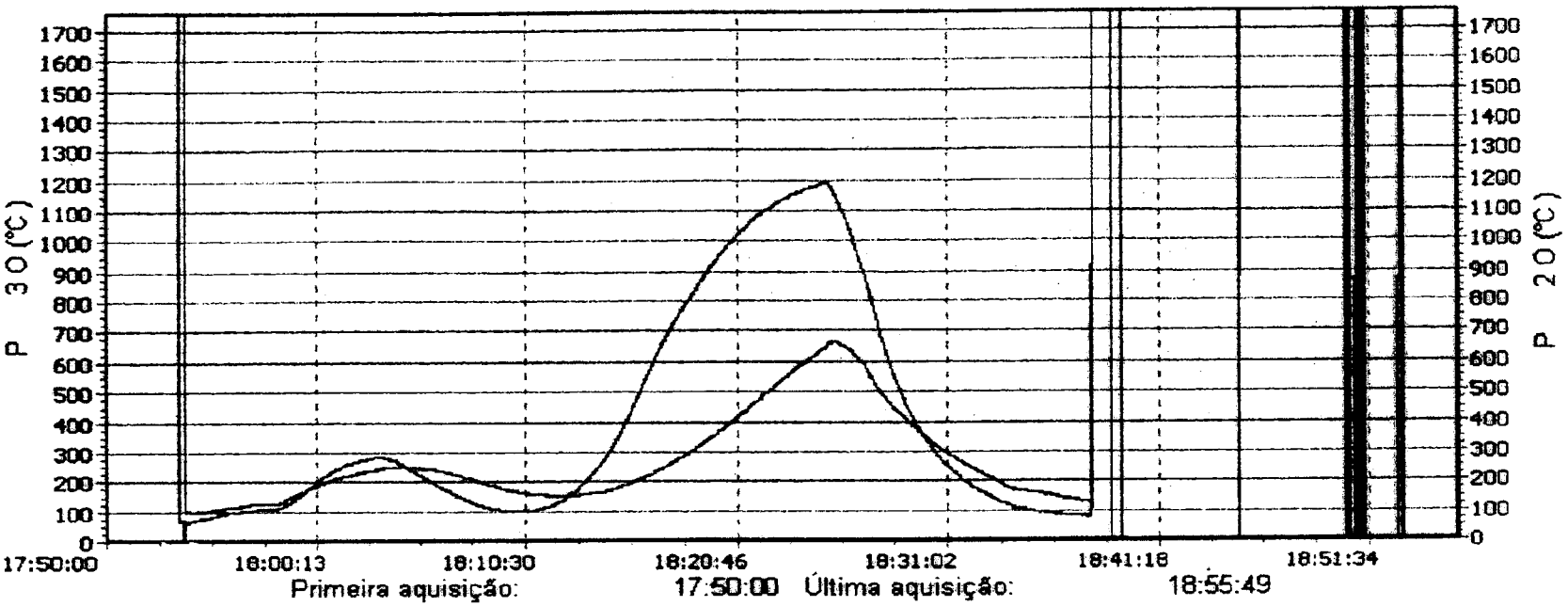

FIGS. 5, 6, 7 and 8 represent, schematically and respectively, the connecting end of the thermal detector rod and the data collector, and the angular locking mechanism thereof in relation to the side of the grate car, and the corresponding positioning of the end of the temperature detecting rod of said thermal detector in relation to the grate car support plan; and FIG. 9 represents a graph generated by the measuring unit showing the temperature values that are continuously obtained between two sites of the burning process in the interior of the furnace.

In accordance with these illustrations, the device for continuously measuring the temperature in pelletizing furnaces object of the present invention is basically comprised of a plurality of temperature detectors 1 and 2 disposed at fixed sites of the grate car 10 that follow the latter along the furnace, not illustrated, in order to continuously and instantaneously inform, through data collectors and measuring units, also not illustrated, the actual burning temperature of the product at the detected site.

Figure 4:
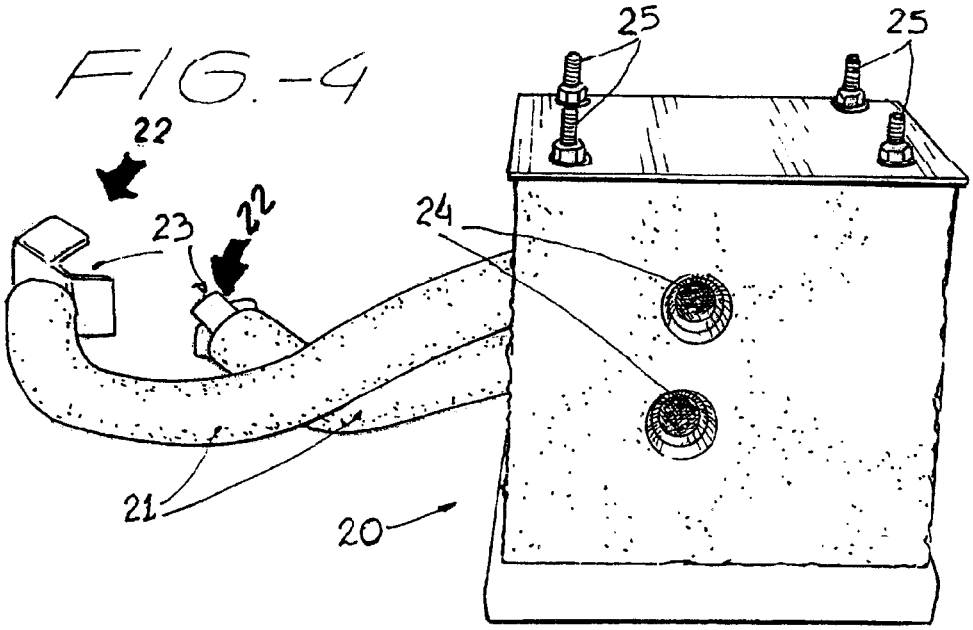
FIG. 4 represents an expanded perspective detailed view of the case for encapsulating the data collectors to be attached to the grate car.

As mentioned above, all the temperature detectors 1, 2 are connected to a data collector that is embedded in a housing 20, shown in FIG. 4, which also is attached to the grate car 10, in order to follow the latter as it moves through the interior of the furnace.

The data collector inside the housing 20 is interconnected by means of the tightening lines 21 to said detectors 1 and 2, by means of male couplers 22 and female 23 couplers, see FIGS. 4, 5 and 7, in such a way that all detectors 1 and 2 provided in the grate car 10 can be permanently monitored by the measuring units that receive and analyze the data and issue thermal profile graphs of the burning process, as shown in FIG. 9.

Figure 2:
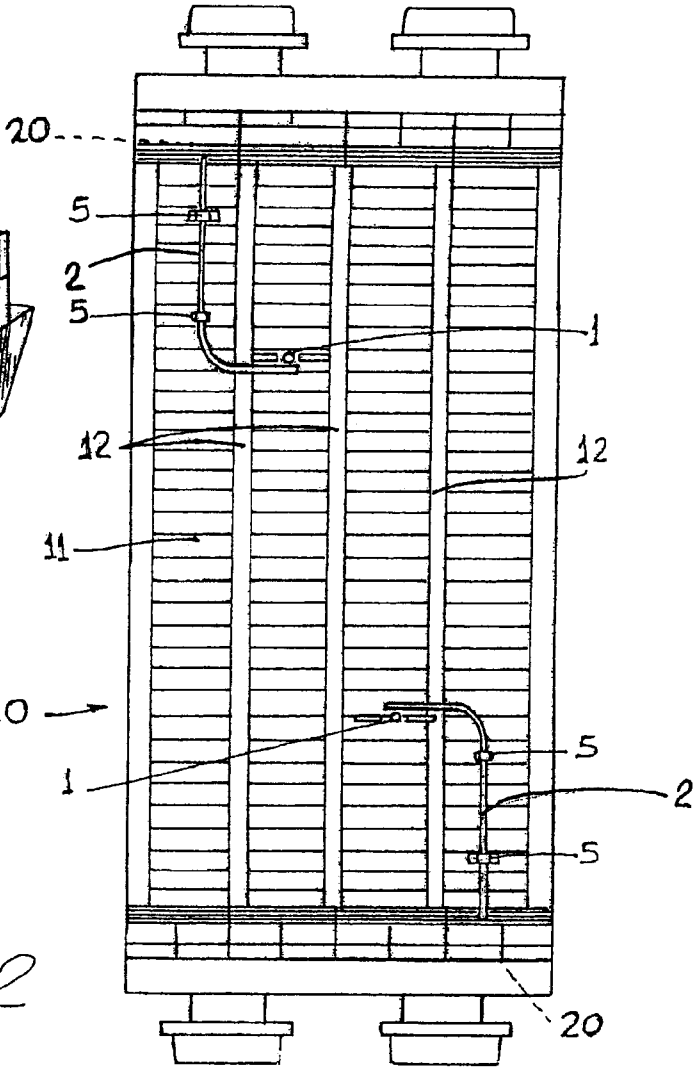
FIG. 2 represents a top view of a grate car provided with temperature detectors of the top type and the type that can be angularly displaced in relation to the grate car support plan.
Figure 1:
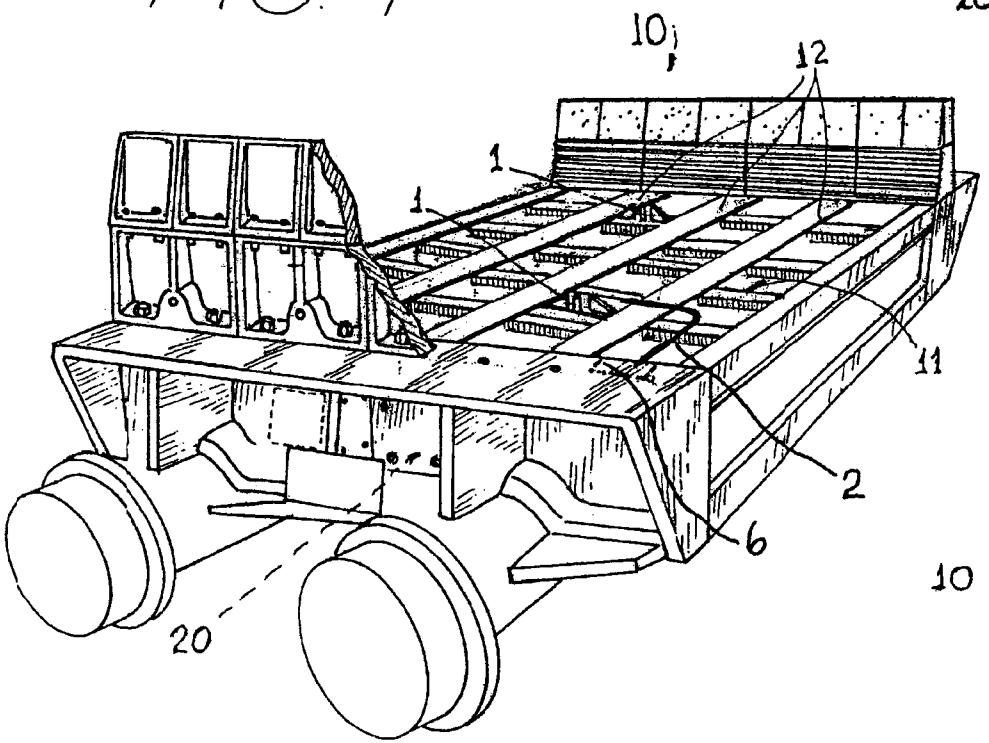
FIG. 1 represents a perspective view of a grate car having its side partially cut for a better visualization of said top temperature detectors disposed along the sites on the car platform.
Figure 3:
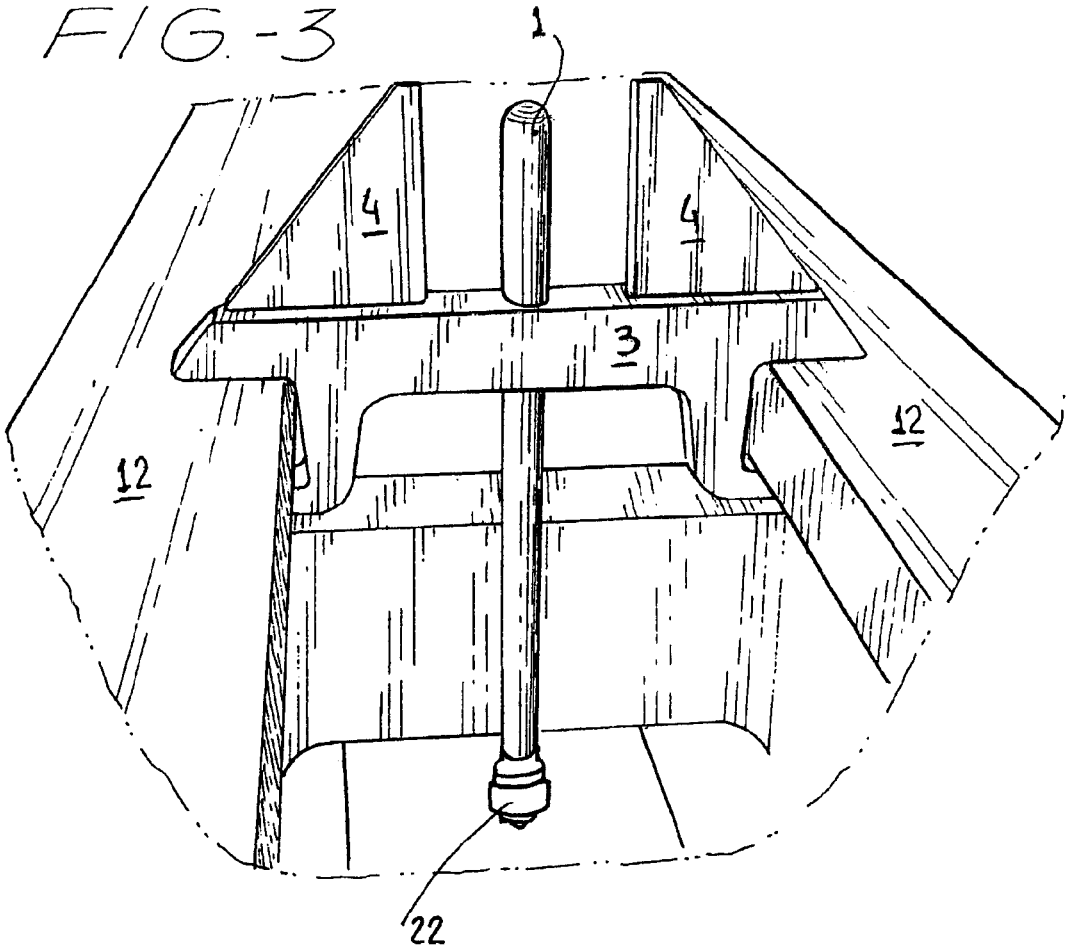
FIG. 3 represents an expanded perspective detailed view of the top detector disposed between the grate car structure, before receiving the bars that make out the support plan.

As can be seen in FIG. 3, one type of the temperatures detectors 1 to be attached to the grate car 10 is defined by a linear straight cylindrical rod mounted orthogonally in relation to the support plan 11 and fixed between the structures 12 of said support plan 11 by means of the longitudinal fastening fingers 3 that incorporate the triangular projections 4 coplanar to the end of said top temperature detector 1.

This type of top detector 1 is designed to measure the temperature on the upper portion of the layer of pellets loaded on the grate car 10, which can reach a depth of 400 mm, and by using said top detector 1 it is possible to measure the temperature of the pellet interface disposed between the backing layer of 100 mm and the raw pellet layer.

On the other hand, in FIGS. 2, 5, 6, 7 and 8, the detector having an "L" shaped cylindrical rod 2 and horizontally mounted coplanar to the support plan 11 and attached to the latter by means of half-jackets 5 that fasten axially the sensing rod 2 to the structures 12 of said support plan 11 but allow for a rotational and selective displacement of this longitudinal portion of the "L" shaped rod in order to allow the transversal portion of said rod 2 to angularly pivot in relation to the support plan 11 of the grate car 10, thus making it possible to define the height required for measuring the temperature of a pellet bed disposed on the grate car 10.

The positioning of the detector having the "L" shaped rod is changed by a guiding and locking mechanism defined by a through hole 6 on the side of the grate car 10, said through hole 6 being provided with a pair of collars 7 on each of its side ends into which a locking pin 8 is selectively fitted, thus retaining the end of the male coupler 22 of the detector rod 2 between same and the respective end of the through hole 6, therefore positioning the opposing end of the measuring unit either horizontally, as seen in FIGS. 5 and 6, or vertically, as seen in FIGS. 7 and 8.

The housing 20 for conditioning and protecting the data collectors, illustrated in FIG. 4, is made from a refractory material and is preferably parallelepipedical shaped and provided with two front circular openings 24 that define inspection holes that make it possible to read the data collected, without the need to open the housing 20. The latter is provided with bolts 25 that make it possible to attach same to the grate car 10. Thus, the detectors 1 and the 2 and the data collectors inside the housings 20 are displaced together with the grate car 10 while it moves along the furnace.

Although a preferred constructive concept has been described and illustrated, it should be clarified that design changes are possible and attainable without departing from the scope of the present invention.

What is claimed is:

1. A DEVICE FOR CONTINUOUSLY MEASURING THE TEMPERATURE IN PELLETIZING FURNACES, comprising:

a plurality of temperature detectors disposed at fixed sites on a grate car that follow said grate car along the furnace and thus continuously and instantaneously inform, through data collectors and measuring units housed on said grate car, the actual burning temperature of product at a detected site.

2. THE DEVICE FOR CONTINUOUSLY MEASURING THE TEMPERATURE IN PELLETIZING FURNACES according to claim 1, wherein the temperature detectors are connected to the data collectors which in turn, are enclosed in housings fixed to the grate car.

3. THE DEVICE FOR CONTINUOUSLY MEASURING THE TEMPERATURE IN PELLETIZING FURNACES according to claim 1, wherein the data collectors enclosed inside the housings are connected by means of tightening lines to said temperature detectors; the lines having male and female couplers.

4. THE DEVICE FOR CONTINUOUSLY MEASURING THE TEMPERATURE IN PELLETIZING FURNACES according to claim 1, characterized in that one of the temperature detectors of said plurality is a linear straight cylindrical rod mounted orthogonally to a support plan on said grate car through longitudinal fastening fingers that incorporate triangular projections coplanar to the end of the said temperature detector.

5. THE DEVICE FOR CONTINUOUSLY MEASURING THE TEMPERATURE IN PELLETIZING FURNACES according to claim 4, wherein another of the temperature detectors is defined by an "L" shaped cylindrical rod and horizontally mounted coplanar to the support plan and attached by half-jackets that fasten axially to said support plan but allow for a rotational and selective displacement of said another of the temperature detectors, so that a transversal portion thereof can be angularly pivoted in relation to the support plan of the grate car.

6. THE DEVICE FOR CONTINUOUSLY MEASURING THE TEMPERATURE IN PELLETIZING FURNACES according to claim 5, wherein the position of said another of the temperature detectors can be changed by a guiding and locking mechanism defined through an opening in the grate car provided in each of its side ends with a pair of collars into which a locking pin is selectively inserted, said locking pin retaining a male coupler of the said another of the temperature detectors between the locking pin and the opening, therefore allowing for the horizontal or vertical positioning of an opposing end of the said another of the temperature detectors.

7. THE DEVICE FOR CONTINUOUSLY MEASURING THE TEMPERATURE IN PELLETIZING FURNACES according to claim 2, wherein the housings are parallelepipedical shaped and are each provided with two front circular openings that define inspection holes for reading data collected by said data collectors, and are each provided with bolts for fastening the housings to the grate car.

* * * * *

UNITED STATES PATENT AND TRADEMARK OFFICE

CERTIFICATE OF CORRECTION

PATENT NO. : 6,656,414 B2 
DATED : December 2, 2003
INVENTOR(S) : Claudemir Chateaubriand De Souza et al.

It is certified that error appears in the above-identified patent and that said Letters Patent is hereby corrected as shown below:

Title page,
Item [73], Assignee, should read:
-- Companhia Vale Do Rio Doce --

Signed and Sealed this

Third Day of February, 2004

JON W. DUDAS
*Acting Director of the United States Patent and Trademark Office*